US006682203B2

(12) United States Patent
Shiau

(10) Patent No.: US 6,682,203 B2
(45) Date of Patent: Jan. 27, 2004

(54) FLASHLIGHT WITH A CONNECTING DEVICE FOR CONNECTING LAMP TERMINALS OF A LAMP UNIT TO A BARREL AND A BATTERY UNIT

(76) Inventor: Wen-Chin Shiau, No. 10, Alley 1, Lane 551, Sec. 1, Wan-Shou Rd., Kuei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 10/170,389

(22) Filed: Jun. 14, 2002

(65) Prior Publication Data

US 2003/0231492 A1 Dec. 18, 2003

(51) Int. Cl.[7] ..... F21L 4/00

(52) U.S. Cl. ..... 362/202; 362/187; 362/206; 362/207; 362/184; 362/205; 362/186; 362/188

(58) Field of Search ..... 362/202, 187, 362/206, 207, 184, 205, 186, 188

(56) References Cited

U.S. PATENT DOCUMENTS 5,070,438 A * 12/1991 Marshall ..... 362/206
6,196,698 B1 * 3/2001 Maglica ..... 362/205
6,347,878 B1 * 2/2002 Shiao ..... 362/157

* cited by examiner

*Primary Examiner*—Sandra O'Shea
*Assistant Examiner*—Mark Tsidulko
(74) *Attorney, Agent, or Firm*—Foley & Lardner

(57) ABSTRACT

A flashlight includes a conductive barrel, a lamp unit, a connecting device and a tail cap unit. The connecting device includes a conductive ring, an insulator seat, a conductive biasing member and a positioning cap. The biasing member is disposed in a retaining hole in the insulator seat, and is prevented from removal from the retaining hole by the positioning cap.

3 Claims, 2 Drawing Sheets

FLASHLIGHT WITH A CONNECTING DEVICE FOR CONNECTING LAMP TERMINALS OF A LAMP UNIT TO A BARREL AND A BATTERY UNIT

BACKGROUND OF THE INVENTION

1. Field of the Invention

The invention relates to a flashlight, more particularly to a flashlight with a connecting device for connecting lamp terminals of a lamp unit to a barrel and a battery unit.

2. Description of the Related Art

A conventional flashlight includes a conductive barrel, a lamp unit, a connecting device, and a tail cap unit. The conductive barrel is adapted to receive a battery unit therein, extends in a longitudinal direction, and has a front end and a rear end. The battery unit has a first electrode and a second electrode opposite to the first electrode in the longitudinal direction. The lamp unit is disposed at the front end of the barrel, and includes a lamp base and a lamp retained on the lamp base. The lamp unit has a central lamp terminal and a peripheral lamp terminal. The connecting device includes a conductive ring disposed between the lamp base and the front end of the barrel to connect the peripheral lamp terminal electrically to the barrel, an insulator seat fitted in the conductive ring and formed with a through hole that is aligned with the central lamp terminal, and a conductive biasing member disposed in the through hole and having a first biasing end that is adapted to contact electrically the first electrode and a second biasing end that contacts electrically the central lamp terminal. The tail cap unit is mounted on the rear end of the barrel, and is adapted to connect electrically the second electrode to the barrel.

The following is a drawback of the aforesaid conventional flashlight: When the tail cap unit is removed during replacement of the battery unit, the conductive biasing member of the connecting device may fall out of the insulator seat since there is no positioning mechanism for preventing undesired removal of the same, thereby resulting in inconvenience or even failure of the flashlight due to component loss.

SUMMARY OF THE INVENTION

Therefore, the main object of the present invention is to provide a flashlight that can overcome the aforesaid drawback associated with the prior art.

Accordingly, a flashlight of this invention comprises:

- a conductive barrel adapted to receive a battery unit therein, the barrel extending in a longitudinal direction and having a front end and a rear end, the battery unit having a first electrode and a second electrode opposite to the first electrode in the longitudinal direction;
- a lamp unit disposed at the front end of the barrel and including a lamp base and a lamp retained on the lamp base, the lamp unit having a central lamp terminal and a peripheral lamp terminal;
- a connecting device including
  - a conductive ring disposed between the lamp base and the front end of the barrel to connect the peripheral lamp terminal electrically to the barrel,
  - an insulator seat fitted in the conductive ring and formed with a retaining hole that is aligned with the central lamp terminal, the retaining hole having a first open end remote from the central lamp terminal, and a second open end proximate to the central lamp terminal,

- a positioning cap mounted on the insulator seat at the first open end of the retaining hole and formed with a through-hole, and
  - a conductive biasing member disposed in the retaining hole and having a first biasing end that extends through the through-hole in the positioning cap and that is adapted to contact electrically the first electrode, an intermediate section that is connected to the first biasing end, that is wider than the through-hole, and that is disposed in the retaining hole, and a second biasing end that is connected to the intermediate section, that extends through the second open end of the retaining hole, and that contacts electrically the central lamp terminal; and
- a tail cap unit mounted on the rear end of the barrel and adapted to connect electrically the second electrode to the barrel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
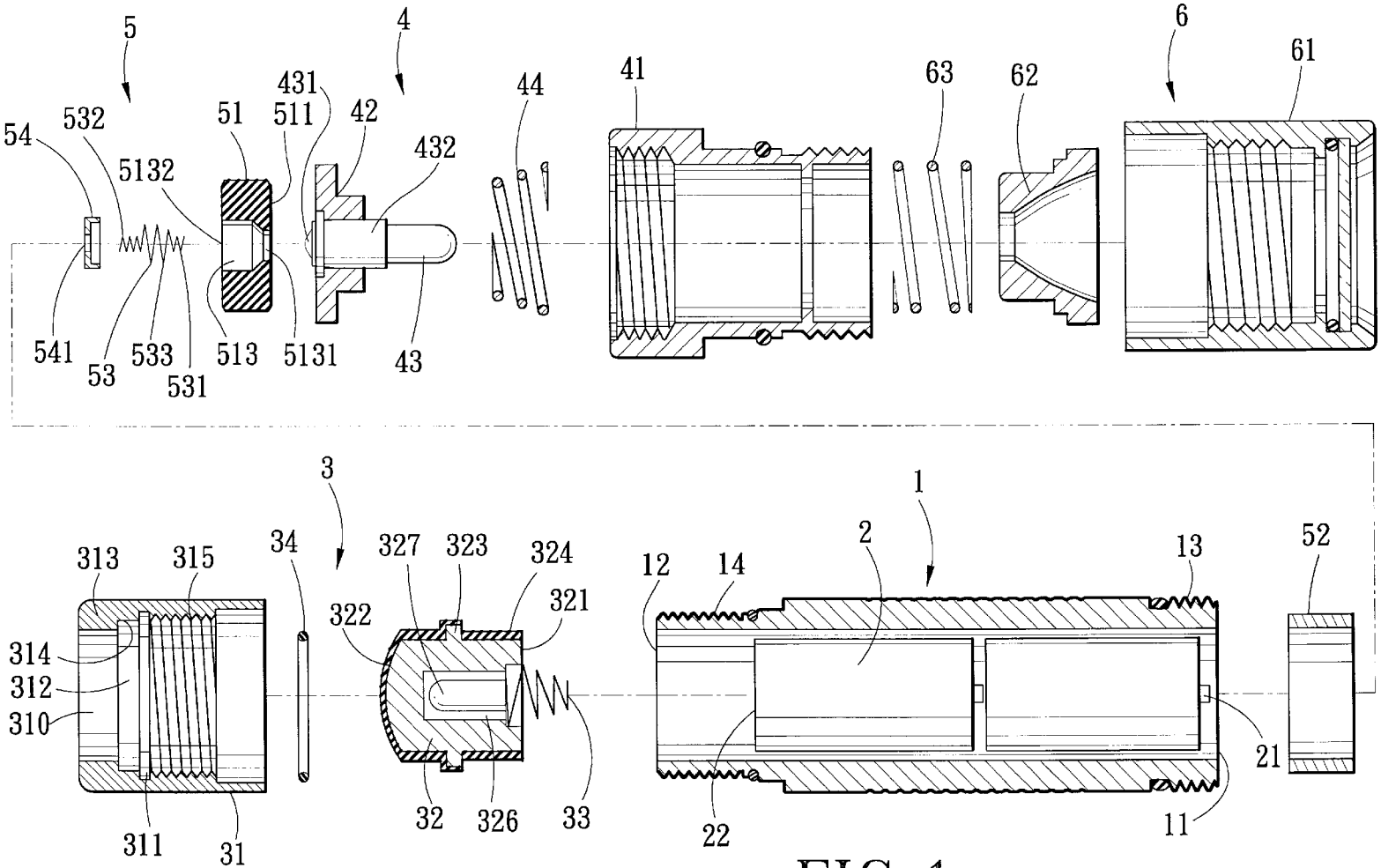
FIG. 1 is an exploded sectional view showing a preferred embodiment of a flashlight according to the present invention.
Figure 2:
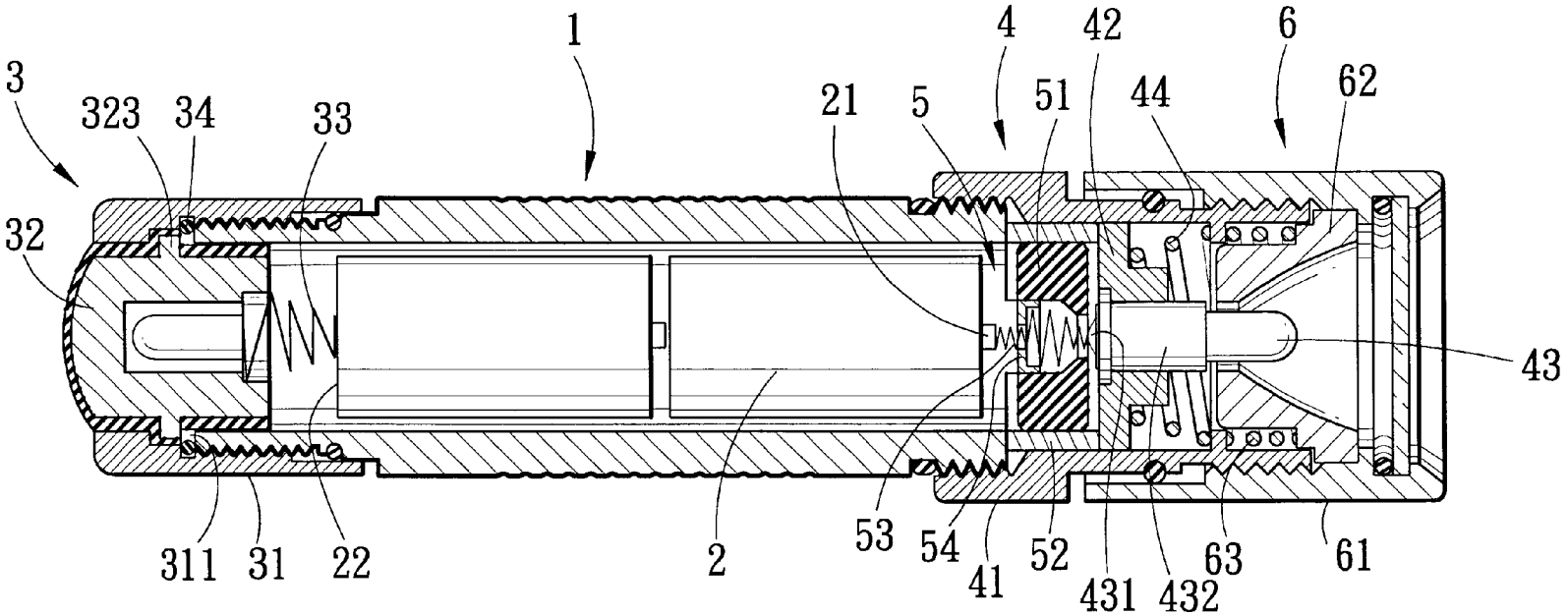
FIG. 2 is an assembled sectional view showing the preferred embodiment of a flashlight according to the present invention.

Referring to FIGS. 1 and 2, the preferred embodiment of a flashlight according to the present invention is shown to include a conductive barrel 1, a tail cap unit a lamp unit 4, a connecting device 5 and a head assembly 6.

The conductive barrel 1 is made of metal and is adapted to receive a battery unit 2 therein. The barrel 2 extends in longitudinal direction, and has an externally threaded front end portion 13 with a distal front end face 11, and an externally threaded rear end portion 14 with a distal rear end face 12. Preferably, the outer wall surface of the conductive barrel 1 is coated with an insulator layer (not shown). The battery unit 2 includes one or more batteries, and has a first electrode 21 and a second electrode 22 opposite to the first electrode 21 in the longitudinal direction.

The tail cap unit 3 is mounted on the rear end portion 14 of the barrel 1, and includes a tail cap member 31, a push button member 32, a conductive biasing member 33, and an annular blocking member 34. The tail cap member 31 has an end wall 313 and a tubular wall 314 extending from a periphery of the end wall 313 in the longitudinal direction. The end wall 313 is formed with a button hole 310. The tubular wall 314 has an inner wall surface formed with an internally threaded segment 315 that is spaced apart from the end wall 313 in the longitudinal direction and that cooperates with the end wall 313 to form a contact receiving space 312. The internally threaded segment 315 threadedly engages the rear end portion 14 of the barrel 1, and forms an annular shoulder 311 at a boundary with the contact receiving space 312. The push button member 322 is made of metal, and has an operating portion 322 slidably extending through the button hole 310, a conductive contact portion 323 connected to the operating portion 322 and extending into the contact receiving space 312, and a tubular support 321 that extends from the conductive contact portion 323 and slidably into the rear end portion 14 of the barrel 1. The conductive contact portion 323 is disposed to confront the distal rear end face 12 of the barrel 1 in the longitudinal direction. An insulator layer 324 on the outer wall surface of the push button member 32 prevents electrical connection between the conductive contact portion 323 and the barrel 1 via the tail cap member 31. The tubular support 321 is formed integrally with the conductive contact portion 323 and is formed with a cavity 326, where a spare lamp 327 can be disposed. The blocking member 34, such as a C-shaped ring in this embodiment, is made of an insulator material, is disposed within the contact receiving space 312, and a buts against the annular shoulder 311. The blocking member 34 may be circular or rectangular in cross-section. When the cross-section is circular, the push button member 32 can be forcibly removed from the tail cap member 31. When the cross-section is rectangular, the blocking member 34 can guard against the push button member 32 from the tail cap member 31. The conductive biasing member 33 has a first biasing end adapted to contact electrically the second electrode 22 of the battery unit and a second biasing end disposed in the tubular support 321 and electrically connected to the conductive contact portion 323.

The lamp unit 4 is disposed at the front end portion 13 of the barrel 1, and includes a head cap 41, a conductive lamp base 42, a lamp 43 retained on the lamp base 42, and a biasing member 44. The head cap 41 has an inner wall surface formed with an internally threaded segment that threadedly engages the front end portion 13 of the barrel 1. The lamp 43 has a central lamp terminal 431 and a peripheral lamp terminal 432 around the central lamp terminal 431. The lamp base 42 and the lamp 43 are disposed inside the head cap 41 and are urged towards the distal front end face 11 of the barrel 1 by the biasing member 44.

The connecting device 5 includes a conductive ring 52, an insulator seat 51, a conductive biasing member 53 and a positioning cap 54. The conductive ring 52 is disposed between the lamp base 42 and the distal front end face 11 of the barrel 1 such that the peripheral lamp terminal 432 is connected electrically to the barrel 1 via the lamp base 42 and the conductive ring 52. The insulator seat 51 is fitted in the conductive ring 52, has an end surface 511 confronting the lamp base 42, and is formed with a retaining hole 513 that is aligned with the central lamp terminal 431. The retaining hole 513 has a first open end 5132 remote from the central lamp terminal 431, and a second open end 5131 proximate to the central lamp terminal 431. The positioning cap 54 is mounted on the insulator seat 51 at the first open end 5132 of the retaining hole 513, and is formed with a through-hole 541. The conductive biasing member 53 is a coil spring in this embodiment, is disposed in the retaining hole 513, and has a first biasing end 532 that extends through the through-hole 541 in the positioning cap 54 and that is adapted to contact electrically the first electrode 21 of the battery unit 2, an intermediate section 533 that is connected to the first biasing end 532, that is wider than the through-hole 541, and that is disposed in the retaining hole 513, and a second biasing end 531 that is connected to the intermediate section 533, that extends through the second open end 5131 of the retaining hole 513, and that contacts electrically the central lamp terminal 431. The second open end 5131 of the retaining hole 513 is narrower than the intermediate section 533 of the conductive biasing member 53. Since the intermediate section 533 of the conductive biasing member 53 is wider than the through-hole 541, the positioning cap 54 can prevent untimely removal of the biasing member 53 from the retaining hole 513.

The head assembly 6 includes a reflector cap 61 coupled threadedly to the head cap 41 of the lamp unit 4, a reflector 62 disposed in the reflector cap 62 and having an open tail end to receive the lamp 43, and a biasing member 63 disposed between and abutting against the head cap 41 and the reflector cap 61 such that when reflector cap 61 is controllably translated relative to the barrel 1, the relative distance between the reflector 62 and the lamp 43 is adjusted, thereby adjusting the lamp light focusing.

In practice, the tail cap member 31 is adjustable relative to the barrel 1 to switch on and off the lamp 43.

To turn on the lamp 43, either the tail cap member 31 is threadedly rotated to move toward the rear end portion 14 of the barrel 1 or an external pressing force is applied on the operating portion 322 of the push button member 32 SO as to move the latter in the longitudinal direction against biasing action of the biasing member 33 to abut the conductive contact portion 323 against the distal rear end face 12 of the barrel 1, thereby forming a closed circuit constituted by the second electrode 22 of the battery unit 2, the biasing member 33, the push button member 32, the barrel 1, the conductive ring 52, the lamp base 42, the peripheral lamp terminal 432, the central lamp terminal 431, the biasing member 53 and the first electrode 21 of the battery unit 2.

On the other hand, to turn off the lamp 43, the tail cap member 31 is threadedly rotated to move away from the rear end portion 14 of the barrel 1 such that by virtue of the biasing action of the conductive biasing member 33, the conductive contact portion 323 is urged to abut against the end wall 313 of the tail cap member 31 and is spaced apart from the distal rear end face 12 of the barrel 1 to break electrical connection between the conductive contact portion 323 and the barrel 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A flashlight comprising:

a conductive barrel adapted to receive a battery unit therein, said barrel extending in a longitudinal direction and having a front end and a rear end, the battery unit having a first electrode and a second electrode opposite to the first electrode in the longitudinal direction;

a lamp unit disposed at said front end of said barrel and including a lamp base and a lamp retained on said lamp base, said lamp unit having a central lamp terminal and a peripheral lamp terminal;

a connecting device including a conductive ring disposed between said lamp base and said front end of said barrel to connect said peripheral lamp terminal electrically to said barrel, an insulator seat fitted in said conductive ring and formed with a retaining hole that is aligned with said central lamp terminal, said retaining hole having a first open end remote from said central lamp terminal, and a second open end proximate to said central lamp terminal, a positioning cap mounted on said insulator seat at said first open end of said retaining hole and formed with a through-hole, and a conductive biasing member disposed in said retaining hole and having a first biasing end that extends through said through-hole in said positioning cap and that is adapted to contact electrically the first electrode, an intermediate section that is connected to said first biasing end, that is wider than said through-hole, and that is disposed in said retaining hole, and a second biasing end that is connected to said intermediate section, that extends through said second open end of said retaining hole, and that contacts electrically said central lamp terminal; and a tail cap unit mounted on said rear end of said barrel and adapted to connect electrically the second electrode to said barrel, wherein said second open end of said retaining hole is narrower than said intermediate section of said conductive biasing member.

2. The flashlight as claimed in claim 1, wherein said conductive biasing member is a coil-spring.

3. The flashlight as claimed in claim 1, wherein said lamp unit further includes a head cap mounted on said front end of said barrel and having said lamp base and said connecting device disposed therein.

* * * * *